US009676210B2

(12) United States Patent
Emamjomeh et al.

(10) Patent No.: US 9,676,210 B2
(45) Date of Patent: Jun. 13, 2017

(54) PRINTING SYSTEM AND METHOD

(71) Applicant: Hewlett-Packard Development Company, L.P., Houston, TX (US)

(72) Inventors: Ali Emamjomeh, San Diego, CA (US); Jayanta C. Panditaratne, San Diego, CA (US); Radha Sen, San Diego, CA (US); Nathan Kazutoshi Denni, San Diego, CA (US); Donna M. Sirenski, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/001,732

(22) Filed: Jan. 20, 2016

(65) Prior Publication Data

US 2016/0144634 A1 May 26, 2016

Related U.S. Application Data

(63) Continuation of application No. 14/238,934, filed as application No. PCT/US2011/048042 on Aug. 17, 2011, now Pat. No. 9,272,540.

(51) Int. Cl.
*B41J 11/00* (2006.01)
*B41J 29/38* (2006.01)
(Continued)

(52) U.S. Cl.
CPC ..... *B41J 11/002* (2013.01); *B41J 11/0015* (2013.01); *B41J 11/425* (2013.01);
(Continued)

(58) Field of Classification Search
None
See application file for complete search history.

(56) References Cited

U.S. PATENT DOCUMENTS 6,012,809 A 1/2000 Ikeda et al.
6,406,118 B1 6/2002 Aoki et al.
(Continued)

FOREIGN PATENT DOCUMENTS

WO WO-2011021591 A1 2/2011

OTHER PUBLICATIONS

International Search Report and Written Opinion dated Apr. 24, 2012, PCT/US2011/048042 dated Aug. 17, 2011 (ISA/KR).

*Primary Examiner* — An Do
*Assistant Examiner* — Renee I Wilson
(74) *Attorney, Agent, or Firm* — Dierker & Kavanaugh, P.C.

(57) ABSTRACT

A printing system includes a media transport device to move a medium at a speed ranging from about 15.24 mpm to about 609.6 mpm. The system includes an ink applicator to apply ink on the medium, and a treatment applicator to apply a treatment composition (including liquid vehicle, polyvalent metal salt fixing agent, and latex resin having an acid number less than 20) before or after the ink is applied, to form a printed-on medium. The system further includes a heating system programmed to: i) dry the printed-on medium at a predetermined temperature for a reduced dwell time (from about 1 second to about 40 seconds); and ii) leave residual moisture in the printed-on medium for a predetermined time after the reduced dwell time. The residual moisture is at a level that is higher than an initial moisture content of the medium prior to treatment composition and ink application.

11 Claims, 2 Drawing Sheets

(51) Int. Cl.
*B41J 11/42* (2006.01)
*B41M 7/00* (2006.01)
*B41M 5/00* (2006.01)

(52) U.S. Cl.
CPC ..... *B41J 29/38* (2013.01); *B41M 5/0017* (2013.01); *B41M 7/00* (2013.01); *B41M 7/0018* (2013.01)

(56) References Cited

U.S. PATENT DOCUMENTS

| | | | | |
|---|---|---|---|---|
| 7,780,773 | B2 | 8/2010 | Kovacs et al. | |
| 2004/0050279 | A1 | 3/2004 | Ibarra et al. | |
| 2006/0191426 | A1 | 8/2006 | Timmerman et al. | |
| 2007/0067928 | A1 | 3/2007 | Ellis | |
| 2007/0153074 | A1* | 7/2007 | Anderson | B41J 11/002 347/102 |
| 2008/0213621 | A1 | 9/2008 | Takashima et al. | |
| 2008/0282921 | A1 | 11/2008 | Macpherson et al. | |
| 2010/0092199 | A1* | 4/2010 | Biegelsen | G03G 15/2039 399/68 |
| 2010/0231671 | A1 | 9/2010 | Anton et al. | |
| 2011/0267396 | A1 | 11/2011 | Yamamoto et al. | |
| 2011/0303113 | A1 | 12/2011 | Sarkisian et al. | |
| 2011/0304661 | A1 | 12/2011 | Emamjomeh et al. | |

* cited by examiner

PRINTING SYSTEM AND METHOD

The present application is a Continuation application of U.S. patent application Ser. No. 14/238,934, filed on Feb. 14, 2014, which is a national stage filing under 35 U.S.C 371 of PCT application number PCT/US2011/048042, having an international filing date of Aug. 17, 2011, the disclosures of which are hereby incorporated by reference in their entireties.

BACKGROUND

The present disclosure relates generally to printing systems and methods.

In addition to home and office usage, inkjet technology has been expanded to high-speed, commercial and industrial printing. Inkjet printing is a non-impact printing method that utilizes electronic signals to control and direct droplets or a stream of ink to be deposited on media. Current inkjet printing technology involves forcing the ink drops through small nozzles by thermal ejection, piezoelectric pressure or oscillation onto the surface of the media. This technology has become a popular way of recording images on various media surfaces (e.g., paper), for a number of reasons, including, low printer noise, capability of high-speed recording and multi-color recording.

High-speed, commercial and industrial printing often involves high speed printing on offset media. Inkjet inks are often water-based inks that have a relatively long dry time. This property renders inkjet inks undesirable for high-speed printing, at least in part because the speed of printing may result in the smearing of printed images.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the printing system disclosed herein are high-speed printing systems that utilize inkjet inks and offset media. The systems incorporate one or more applicators to apply a pre-treatment or a post-treatment composition to the media during the overall printing process. The introduction of the pre-treatment or post-treatment composition leads to a reduced drying load compared to, for example, systems that do not apply a treatment composition to the media. It is believed that the reduced drying load is the result of the pre-treatment composition creating a film (e.g., a mixture of ink and pre-treatment composition) on the media, or the post-treatment composition creating a protective layer over ink previously applied to the media. This film and this layer are durable at relatively high residual moisture levels immediately after drying. The durability during this time period enables the inkjet printed-on media to undergo finishing processes immediately after drying. This is particularly desirable for high-speed printing applications.

High-speed printing may include printing 15.24 meters per minute (mpm) (i.e., 50 feet per minute (fpm)) or more. In an example, high-speed printing of the systems disclosed herein ranges from about 15.24 mpm to about 609.6 mpm (i.e., from about 50 fpm to about 2,000 fpm). These printing speeds are generally well suitable for industrial and/or commercial printing. In some examples, the systems disclosed herein are capable of printing from about 15.24 mpm to about 304.8 mpm (i.e., from about 50 fpm to about 1,000 fpm). In some other examples, the systems disclosed herein are capable of printing from about 15.24 mpm to about 121.92 mpm (i.e., from about 50 fpm to about 400 fpm).

The printed-on media disclosed herein include one or more images formed via the application of inkjet ink onto the offset media. As used herein, "image" refers to marks, signs, symbols, figures, indications, and/or appearances deposited upon a material or substrate with either a visible or an invisible inkjet ink composition. Examples of an image can include characters, words, numbers, alphanumeric symbols, punctuation, text, lines, underlines, highlights, and the like.

Figure 1:
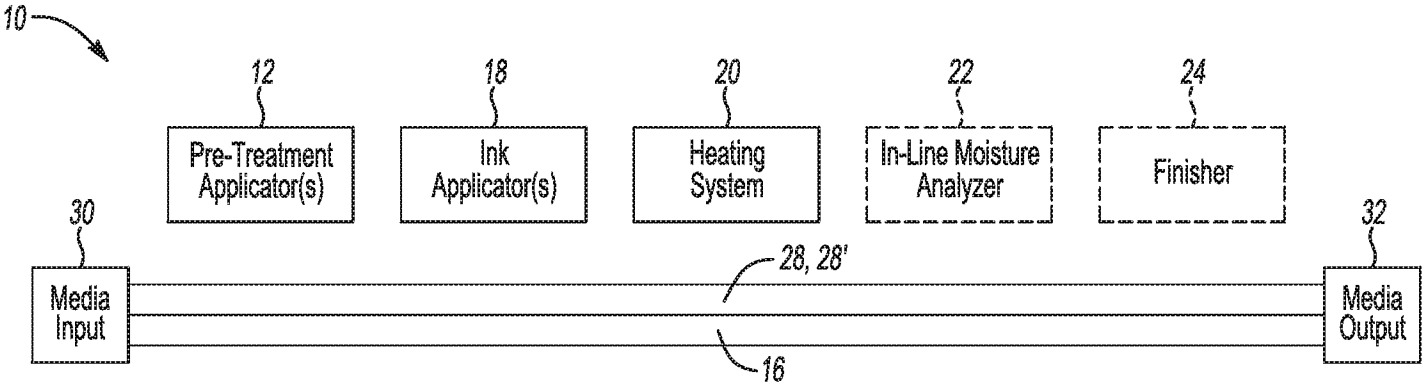
FIG. 1 is a schematic illustration of an example of the printing system.
Figure 2:
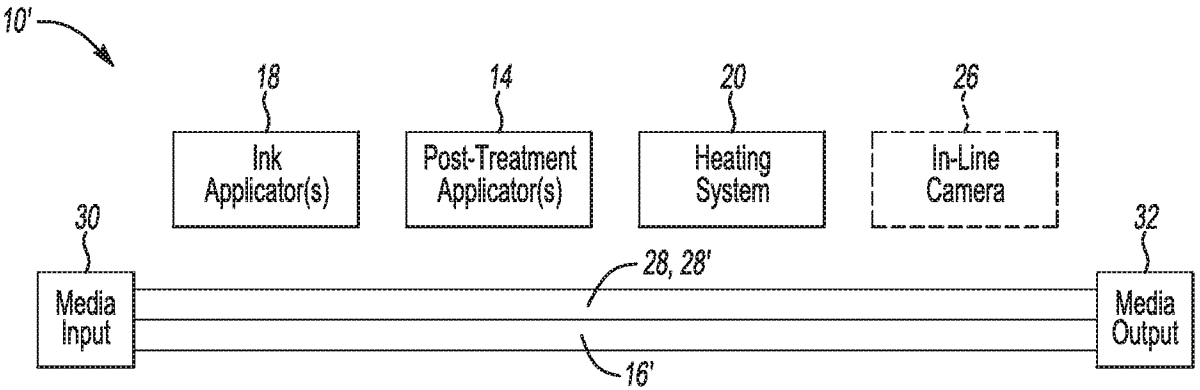
FIG. 2 is a schematic illustration of another example of the printing system.

FIGS. 1 and 2 illustrate two examples of the printing system 10, 10'. The printing system 10 may include, in part, a pre-treatment applicator 12 (see FIG. 1), and the printing system 10' may include, in part, a post-treatment applicator 14 (see FIG. 2). Each of the systems 10, 10' may include a media transport device 16 or 16', one of the treatment applicators 12 or 14, an ink applicator 18 and a heating system 20. While not shown, each of the systems 10, 10' may also include a controller having processing unit(s) that transmit(s) signals to the various system components to operate each of the components in a desirable manner to form image(s) on the medium 28.

Other system components may be included such as, for example, an in-line moisture analyzer 22, a finisher 24, and/or an in-line camera 26. While neither of FIG. 1 or 2 shows all of these components in a single system, it is to be understood that any or all of these additional components may be included in a single system. Each of the systems 10, 10' will be discussed, respectively, in reference to FIGS. 1 and 2, and the description of any duplicate components may not be repeated.

Referring now to FIG. 1, printing system 10 includes the media transport device 16, the pre-treatment composition applicator 12, the ink applicator 18, the heating system 20, the in-line moisture analyzer 22 and the finisher 24. The media transport device 16 is a mechanism that, when in operation, transports or moves a medium 28 relative to and between at least the pre-treatment composition applicator 12, the ink applicator 18 and the heating system 20.

The medium 28 may be porous media, which has an overly porous structure that can absorb the majority of an applied ink. In some examples, the porous medium encompasses a high volume of voids and has a high liquid-absorbing capacity. One example of porous media is paper. The porosity may be attributed to the porosity of the coating structure deposited onto a base substrate or from the base substrate itself. The porosity of the medium 28 may be represented by air permeance, in the range of from 15 to 40 Sheffield unit Parker Print-Surf testers.

The media transport device 16 includes a media input 30 and a media output 32. The input 30 receives the media 28 into the system 10, the output 32 exits the media 28 from the system 10, and the transport device 16 moves the media 28 between the input 30 and the output 32. In an example, the media transport device 16 moves the medium 28 in the form of a web, and the media input 30 and the media output 32 include, respectively, supply and take up rolls. In another example, the media transport device 16 moves the medium 28 in the form of individual sheets. It is to be understood that the media transport device 16 may include rollers, belts, conveyors or other structures to drive and move the medium 28.

In the example shown in FIG. 1, the media transport device 16 is configured to transport media 28 from the pre-treatment applicator 12 to the ink applicator 18 at a rate such that the treatment composition(s) applied to the medium 28 at the pre-treatment applicator 12 is/are substantially moist or wet at the time at which ink from applicator 18 is applied onto the treatment composition(s). For purposes of this disclosure, the term "wet" encompasses liquids in a gel state. Generally, in this example of the system 10, the media transport device 16 moves the medium 28 such that the time interval between the finishing point of the application of the treatment composition and the starting point of the application of the ink ranges from about 1 second to about 30 seconds. In some examples, media transport device 16 moves the medium 28 between the applicator 12 and the applicator 18 in under 10 seconds, and in other examples, in under 5 seconds. In an example, the media transport device 16 is configured to transport the medium 28 from the pre-treatment applicator 12 to the ink applicator 18 in under one second. It is to be understood that the media transport device 16 may have other configurations and may operate at other speeds depending, at least in part, upon the rate at which the pre-treatment composition dries.

The treatment applicator in this example of the system 10 is a pre-treatment applicator 12 because it is positioned to apply the treatment composition onto the medium 28 prior to ink being applied to the medium 28. In an example, the pre-treatment applicator 12 is a roller or roll coater/applicator. The pre-treatment composition may be rolled on the medium 28 using commercial roll coating equipment. When a roller or roll coater/applicator is utilized to apply to the treatment composition, the liquid carrier or water dispensed onto the medium 28 is reduced, which may enhance properties of the medium 28 and its media path. In an example, the roll coater applies the treatment composition such that it covers the medium 28 in a range of about 0.1 grams per square meter (gsm) to about 20 gsm. In another example, the roll coater applies the treatment composition such that it covers the medium 28 up to 2 gsm. It is to be understood that the roll coater of the pre-treatment applicator 12 may be configured to apply the treatment composition at other rates.

The roll coater may also be a transfer roll coating device. In some examples, a set of more than 3 rollers can be used. In some other examples, up to 30 rollers may be used. In an example when transfer roll coating is used, the treatment composition is received onto a first surface, and then a contact is formed between the first surface and a transfer roll. The treatment composition is then transferred from the first surface to the transfer roll. Finally, the treatment composition is transferred from the transfer roller to the print medium 28. In one approach, the treatment composition is applied to the medium 28 just before the printing of inks by pens.

In still other examples, the pre-treatment applicator 12 may include other mechanisms or devices to apply the treatment composition. Examples of other suitable pre-treatment applicators include air doctor coaters, blade coaters, rod coaters, knife coaters, squeeze coaters, impregnation coaters, reverse roll coaters, transfer roll coaters, gravure coaters, kiss-roll coaters, cast coaters, spray coaters, curtain coaters, inkjet devices, and extrusion coaters. Details of coating methods may be referenced in Schweizer, et al., *Liquid Film Coating—Scientific Principles and Their Technological Implications*, Springer, 1st ed. (1997), Cohen, et al., *Modern Coating and Drying Technology*, Wiley-VCH, 1st ed. (1992), and Weinstein, et al., "Coating Flows", *Annu. Rev. Fluid Mech.* (2004). In an example, in order to apply the treatment composition to the medium 28 with a substantially uniform thickness, an air-knife may be used for the coating or a member having an acute angle may be positioned with a gap, corresponding to the predetermined amount of pre-treatment composition, between the member and the medium 28.

The treatment composition contained in the pre-treatment applicator 12 includes a liquid vehicle, a polyvalent metal salt as fixing agent and a latex resin. In some instances, the treatment composition also includes a thickener.

In some examples, the treatment composition has a viscosity ranging from about 100 cps to about 10,000 cps; and in other examples, the viscosity ranges from about 200 cps to about 5,000 cps; and in yet other examples, the viscosity ranges from about 1,000 cps to about 4,000 cps. A method for measuring the viscosity of liquid is described in detail in JIS Z8803. The viscosity can be measured using a commercially available viscometer. In an example, the viscosity is measured at about 25° C., using a Brookfield Viscometer.

In some examples, the treatment composition has a surface tension ranging from about 25 dynes/cm to about 45 dynes/cm; and in some other examples, the surface tension ranges from about 30 dynes/cm to about 40 dynes/cm. As used herein, the surface tension means both dynamic surface tension and static surface tension (either measured at about 25° C.). The surface tension may be adjusted using, for example, nonionic surfactants or the like. Methods for measuring static surface tension include a capillary rise method, a drop method and/or a ring method. Methods for measuring dynamic surface tension include a differential bubble pressure method, an oscillating jet method, a falling meniscus method, a maximum bubble pressure method, and the like.

Without being linked by any theory, it is believed that within such viscosity and surface tension ranges, the treatment composition does not penetrate the media 28 too fast and allows the fluid to remain near the media surface. When applied as a pre-treatment composition, this enables a reaction of the treatment composition with the ink composition. In this example, the pre-treatment composition is able to precipitate with the colorants of the ink composition to achieve desirable mixing. The viscosity and surface tension of the treatment composition facilitate the wet on wet printing mechanism for the system 10 shown in FIG. 1.

As mentioned above, the treatment composition includes a liquid vehicle, which in some instances is an aqueous vehicle. The term "aqueous vehicle," as defined herein, refers to the aqueous mix in which the fixing agent and latex resin are placed to form the treatment composition. Examples of suitable aqueous vehicle components include water, co-solvents, surfactants, additives (corrosion inhibitors, salts, etc.), and/or combinations thereof. In some examples, the aqueous vehicle includes a water soluble organic co-solvent, a surfactant, and water. Examples of the water soluble organic co-solvent include 2-ethyl-2-hydroxymethyl-1,3-propanediol, glycerol propoxylate, tripropylene glycol, 1-(2-hydroxyethyl)-2-pyrrolidinone, 1-(2-hydroxyethyl)-2-imidazolidinone, and/or combinations thereof. Examples of other suitable solvents include amine-N-oxide, ethylene glycol, diethylene glycol, triethylene glycol, 1-propoxy-2-propanol (commercially available as DOWANOL® PNP from The Dow Chemical Co., Midland, Mich.), and combinations thereof. In some examples, an organic co-solvent is present in the treatment composition in an amount up to about 25 wt %; and in some other examples, in an amount ranging from about 0 wt % to about 20 wt %.

The surfactants are selected, in some examples, to function as a defoamer (or defoaming agent). Suitable surfactants include nonionic surfactants, cationic surfactants and combinations thereof.

Suitable cationic surfactants that may be used in the treatment composition include long chain amines and/or their salts, acrylated diamines, polyamines and/or their salts, quaternary ammonium salts, polyoxyethylenated long-chain amines, quaternized polyoxyethylenated long-chain amines, and/or combinations thereof.

Suitable nonionic surfactants include nonionic fluorosurfactants, nonionic acetylenic diol surfactants, nonionic ethoxylated alcohol surfactants and combinations thereof. Several commercially available nonionic surfactants may be used in the formulation of the treatment composition, examples of which include ethoxylated alcohols such as those from the TERGITOL® series (e.g., TERGITOL® 15S30 or TERGITOL® 15S9, manufactured by Dow Chemical); surfactants from the SURFYNOL® series (e.g. SURFYNOL® 440 and SURFYNOL® 465, manufactured by Air Products Co); fluorinated surfactants, such as those from the ZONYL® family (e.g., ZONYL® FSO and ZONYL® FSN, manufactured by E.I. DuPont de Nemours); fluorinated POLYFOX® nonionic surfactants (e.g., PF159 nonionic surfactants), manufactured by Omnova, or combinations thereof. Other nonionic surfactants, such as acetylene glycol-based surfactants and/or polyether denatured siloxane surfactants, may also be used. Examples of acetylene glycol-based surfactants include 2,4,7,9-tetramethyl-5-decyne-4,7-diol; 3,6-dimethyl-4-octyne-3,6-diol; and 3,5-dimethyl-1-hexyne-3-ol. Commercially available acetylene glycol-based surfactants include SURFYNOL® 104, 82, 465, 485, and TG, and OLFIN® STG and OLFIN® E1010 manufactured by Nissin Chemical Industry Co. Examples of polyether denatured siloxane-based surfactants include BYK-345®, BYK-346®, BYK-347®, BYK-348®, and UV3530® of Byk Co.

Other examples of suitable surfactants include SURFYNOL® DF-659, SURFYNOL® DF-58, SURFYNOL® DF-66 (all from Air Products), FOAMMASTER® (from Henkel) BYK®-019, BYK®-021, BYK®-022, BYK®-025 (all from Byk Co.), and Dee Fo 215, Dee Fo XRM-1547A (all from Ultra Additives). In some examples, the surfactants are dispersions of mineral oil in paraffin solvents such as SURFYNOL®210 and/or SURFYNOL®220 available from Air Products Co.

When used, the surfactant(s) may be present in an amount ranging from about 0.01 wt % to about 2 wt % based on the total weight of the treatment composition. In some examples, surfactant(s) may be present in the treatment composition in an amount up to about 1.5 wt %. In other examples, the surfactant(s) may be present in an amount ranging from about 0.1 wt % to about 0.6 wt %. In still other examples, if the surface tension of the treatment composition is at a desirably low level, the composition may not contain surfactants.

Additive(s) may also be incorporated into the treatment composition. As used herein, the term "additive" refers to a constituent of the fluid that operates to enhance performances, environmental effects, aesthetic effects, or other similar properties of the composition. Non-limiting examples of suitable additives include biocides, sequestering agents, chelating agents, anti-corrosion agents, dyes, optical whiteners, brighteners, and/or combinations thereof. In some examples, the treatment composition includes a marker dye such as, for example, Basic Violet 16 (BV 16). Each of the additives can be present in the treatment composition in an amount ranging from about 0.01 wt % to about 1 wt %.

The treatment composition also includes latex resin components. The latex resin can be a cationic, an anionic or an amphoteric polymeric latex resin. In some examples, the latex resin is an anionic polymeric latex resin. The term "latex" refers to a group of preparations consisting of stable dispersions of polymeric micro-particles dispersed in an aqueous matrix. In some examples, the latex resin is present, in the composition, in the form of dispersed latex resin particles.

In an example, the latex resin has an acid number of less than 20. In another example, the latex resin has an acid number of less than 18. As used herein, the acid number (AN) refers to the number that has been measured by conductivity titration of the latent acid functions of the latex resin with nitric acid. As an example, the sample is made strongly basic with KOH, and then is titrated with 1% of $HNO_3$. The pH and conductivity curves are measured simultaneously.

The latex resin may also have a glass transition temperature ($T_g$) ranging from about −22° C. to about 20° C. (i.e., from about −7.6° F. to about 68° F.). In an example, the latex resin may have a glass transition temperature ($T_g$) ranging from about −3° C. to about 7° C. (i.e., from about 26.6° F. to about 44.6° F.). Without being bound to any theory, it is believed that these glass transition temperatures contribute to providing adequate wet-on-wet mixing of the treatment composition (when used as a pre-treatment fluid) and the inkjet ink by modulating the film forming rate of the resin/ink mixture.

The latex resin in the treatment composition may be made of a polymer and/or a copolymer selected from acrylic polymers or copolymers (e.g., vinyl acrylic copolymers or acrylic-polyurethane copolymers), vinyl acetate polymers or copolymers, polyester polymers or copolymers, vinylidene chloride polymers or copolymers, butadiene polymers or copolymers, styrene polymers or copolymers, styrene-butadiene polymers or copolymers, and acrylonitrile-butadiene polymers or copolymers. Examples of suitable commercially available latex resins include HYCAR® or VYCARr® (from Lubrizol Advanced Materials Inc.); RHOPLEX® (from Rohm & Hass company); NEOCAR® (from Dow Chemical Comp.); AQUACER® (from BYK Inc.) or LUCIDENE® (from Rohm & Haas company).

The latex resin may have an average molecular weight (Mw) of about 5,000 to about 500,000. In some examples, the latex resin has an Mw ranging from about 150,000 to about 300,000. In other examples, the latex resin has an Mw of about 250,000.

When particles are utilized, the average particle diameter of the latex resin particles ranges from about 10 nm to about 1 μm. In other examples, the average particle diameter ranges from about 10 nm to about 500 nm or from about 50 nm to about 250 nm. The particle size distribution of the latex is not limited, and it is to be understood that either latex having a broad particle size distribution or latex having a mono dispersed particle size distribution may be used. Some examples include the use of two or more kinds of polymer fine particles, each having a mono-dispersed particle size distribution in combination.

The treatment composition includes the latex resin in an amount ranging from about 1 wt % to about 70 wt % of the total weight of the treatment composition. Other suitable latex resin ranges include, for example, from about 10 wt % to about 60 wt % or from about 20 wt % to about 50 wt %.

As mentioned above, the treatment composition includes, as a fixing agent, a polyvalent metal salt. In some examples, the polyvalent metal salt component is soluble in water. The polyvalent metal salt component may be a divalent or a higher polyvalent metallic ion and anion. Examples of suitable polyvalent metallic ions include divalent metallic ions, such as $Ca^{2+}$, $Cu^{2+}$, $Ni^{2+}$, $Mg^{2+}$, $Zn^{2+}$, and $Ba^{2+}$; trivalent metallic ions, such as $Al^{3+}$, $Fe^{3+}$, and $Cr^{3+}$. In an example, the polyvalent metallic ion is selected from the group consisting of $Ca^{2+}$, $Mg^{2+}$, and $Zn^{2+}$. Some examples of anions include $Cl^-$, $I^-$, $Br^-$, $NO_3^-$ or $RCOO^-$ (where R is H or any hydrocarbon chain). In an example, the polyvalent metal salt anion is either a chloride ($Cl^-$) or an acetate ($CH_3COO^-$). As some specific examples, the polyvalent metal salt may be calcium chloride, calcium nitrate, magnesium nitrate, magnesium acetate or zinc acetate.

In some examples, the polyvalent metal salt is composed of divalent or polyvalent metallic ions and nitrate or carboxylate ions. The carboxylate ions may be derived from a saturated aliphatic monocarboxylic acid having 1 to 6 carbon atoms or a carbocyclic monocarboxylic acid having 7 to 11 carbon atoms. Examples of a saturated aliphatic monocarboxylic acid having 1 to 6 carbon atoms include formic acid, acetic acid, butyric acid, hexanoic acid, isobutyric acid, isovaleric acid, pivalic acid, propionic acid and valeric acid.

The fixing agent is present in the treatment composition in an amount ranging from about 1 wt % to about 20 wt % of the total weight of the treatment composition.

In some examples, the treatment composition includes a thickener. The term "thickener" refers to any component that is able to modify the viscosity of the composition, i.e. a viscosity modifier. The thickener may be a natural derivative thickener or a synthetic thickener. Examples of natural derivative thickeners include cellulose ethers (such as CMC, MC, HEC, EHEC), polysaccharides and/or protineacious thickeners. Examples of synthetic thickeners include polyvinyl alcohol, polyacrylamide, polyacrylic acids and alkali soluble emulsions (such as acrylic and styrene maleic emulsions). In an example, the synthetic thickener is a polymer thickening agent prepared via the polymerization of a methacrylic acid, a methacrylic ester (e.g., methyl methacrylate, ethyl methacrylate, propyl methacrylate, isopropyl methacrylate, butyl methacrylate, n-amyl methacrylate, sec-amyl methacrylate, hexyl methacrylate, lauryl methacrylate, stearyl methacrylate, ethylhexyl methacrylate, crotyl methacrylate, cinnamyl methacrylate, oleyl methacrylate, ricinoleyl methacrylate, hydroxyethyl methacrylate, or hydroxypropyl methacrylate), and/or a saturated aliphatic carboxylic acid vinyl ester (e.g., vinyl acetate, vinyl propionate, vinyl butylate, ter-vinyl butylate, vinyl caprylate, vinyl stearate, vinyl laurate, or vinyl oleate). Other suitable synthetic thickeners include: an acryl emulsion copolymer viscosity modifier prepared by emulsion-polymerizing acrylic acid or methacrylic acid; alkyl acrylate; alkyl methacrylate; hydrophobic group-containing ethoxylated esters of acrylic acid or methacrylic acid; polyethylenically unsaturated monomers; methacrylic acid; a methacrylic or an acrylic ester of an alcohol; a vinyl ester; or a surface-active unsaturated ester. Still other examples of the synthetic thickener include copolymers that are a reaction product of various monomers including methacrylic acid, ethyl acrylate, copolymerizable ethylenically unsaturated monomers, and polyethylenically unsaturated monomers.

Examples of commercially available thickeners include alkali-swellable acrylic thickeners, such as ACRYSOL®Ase-60 (available from Rohm & Haas), ACRYSOL®Ase-75, RHEOLATE® 450 and RHEOLATE® 420; associative thickeners, such as ELEMENTIS RHEOLATE®255 (available from Rheox International Inc.); or copolymers prepared by condensing a polyhydric alcohol with a monoethylenically unsaturated monoisocyanate such as, for example, RHEOLATE® 210, RHEOLATE® 216 and RHEOLATE® 212 (available from Rheox International Inc). Still other commercially available thickeners may be found under the trade names OPTIFLO®, DREWTHIX®, UCAR®, POLYPHOBE®, RHEOTECH®, TEXIPOL®, COAPUR®, etc.

In the example treatment compositions disclosed herein, the thickener, when used, is present in an amount ranging from about 0.01 wt % to about 2 wt % based on the total weight of the treatment composition.

In the example system 10 shown in FIG. 1, the treatment composition disclosed herein is contained in the pre-treatment applicator(s) 12, and once the treatment composition is applied to at least a portion of the medium 28, the media transport device 16 moves the medium 28 in proximity of the ink applicator 18.

The ink applicator 18 disclosed herein is a mechanism that is positioned and programmed to apply ink onto the medium 28 either before or after the treatment composition has been applied to the medium 28. In the example system 10 shown in FIG. 1, the ink applicator 18 is positioned and programmed to apply ink onto the medium 28 after the treatment composition has been applied to the medium 28.

In this example, the ink applicator 18 may be any inkjet device that supplies one or more colors of ink to the medium 28 and over the previously applied treatment composition while the treatment composition is wet. As will be described further hereinbelow, the ink(s) include colorants, such as pigments, dyes, a combination of both, metal particles along with colorants for machine readability (MICR), etc. When the ink(s) is/are applied while the previously applied treatment composition is wet, the colorants become encapsulated and completely surrounded or embedded in the treatment composition. When the treatment composition is used as a pretreatment composition, as the liquid vehicle of the treatment composition is subsequently absorbed into the medium 28 and/or evaporated, the latex particles form a film which covers the encapsulated colorants to form a durable image on the medium 28.

In an example, the ink applicator 18 applies ink(s) to the medium 28 in a range of about 15.24 mpm to about 609.6 mpm (i.e., from about 50 fpm to about 2000 fpm). The ink applicator 18 may be an inkjet printer, such as a thermal inkjet printer (which uses pressure caused by bubbles formed by heating ink), an acoustic inkjet printer (in which an electric signal is transformed into an acoustic beam and ink is irradiated with the acoustic beam so as to be ejected by radiation pressure), or a piezoelectric inkjet printer (a drop-on-demand method which uses vibration pressure of a piezo element). As such, the ink applicator 18 may include printhead(s) and nozzle(s). The ink(s) may be stored in respective reservoirs/cartridges that are in selective fluid communication with one or more printhead(s) and nozzle(s). The ink may be deposited into the printhead and then applied to the media 28 via the nozzle(s). Examples of suitable printhead configurations include single printheads, dual chamber printheads, tri-chamber printheads, or the like.

The ink(s) contained in and dispensed from the ink applicator 18 is/are inkjet inks including an ink vehicle and a colorant. The ink(s) may be black, yellow, cyan, magenta, orange, red, green, or any other desirable color.

The ink vehicle is a liquid in which the colorant is placed to form the ink. Non-limiting examples of suitable components for the ink vehicle include water soluble polymers, anionic polymers, surfactants, solvents, co-solvents, buffers, biocides, sequestering agents, viscosity modifiers, surface-active agents, chelating agents, resins, and/or water, and/or combinations thereof.

Suitable solvents for the ink vehicle include, but are not limited to glycerol polyoxyethyl ether, tripropylene glycol, tetraethylene glycol, 1-(2-hydroxyethyl)-2-imidazolidinone, 1-(2-hydroxyethyl)-2-pyrrolidone, 1,6-hexanediol, 1,2,6-hexanetriol, trimethylolpropane, dipropylene glycol, DANTOCOL® DHE (Lonza Inc., Fairlawn N.J.), and/or combinations thereof. In a non-limiting example, the solvents are present in the ink vehicle in an amount ranging from about 1 wt % to about 25 wt %. In an example, the ink vehicle may include water alone. In some other examples, solvent(s) is/are utilized, and water makes up the balance of the ink composition. Water may be present in an amount ranging from about 40 wt % to about 90 wt % or from about 50 wt % to about 80 wt % of the total ink composition.

The surfactants for the ink vehicle may be nonionic or anionic. Suitable nonionic surfactants for the ink include ethoxylated alcohols, fluorinated surfactants, 2-diglycol surfactants, and/or combinations thereof. Specific examples of nonionic surfactants include those from the SURFYNOL® series (e.g., SURFYNOL® CT211 and SURFYNOL® SEF) or the TERGITOL® previously discussed for the aqueous vehicle of the treatment composition. Suitable anionic surfactants for the ink include those from the DOWFAX® family (e.g., DOWFAX® 8390, manufactured by Dow Chemical Company), or anionic ZONYL® surfactants (e.g., ZONYL® FSA), manufactured by E.I. DuPont de Nemours and Company. Still other suitable anionic surfactants include phosphate ester surfactants (e.g., the EMPHOS® series and the DEDOPHOS® series, both manufactured by Witco Corp., the surfactants of the CRODAFOS® series, manufactured by Croda Inc., the surfactants of the DEPHOTROPE® series and of the DePHOS® series, both manufactured by DeForest Enterprises Inc.); alkyl sulfates (e.g., lauryl sulfate); alkyl ether sulfates (e.g., sodium laureth sulfate); N-lauroyl sarcosinate; dodecylbenzene sulfonate; and/or combinations thereof. In some examples, the ink vehicle includes one or more surfactants present in an amount up to about 8 wt %.

The ink(s) contained in and dispensed from the ink applicator 18 may also include polymeric binders. One example of such polymeric binders includes salts of styrene-(meth)acrylic acid copolymers, which are commercially available and may be selected from the JONCRYL® series (e.g., JONCRYL® 586 and 683), manufactured by BASF Corp.; SMA-1000Na and SMA-1440K, manufactured by Sartomer; Disperbyk 190, manufactured by BYK Chemicals; polystyrene acrylic polymers manufactured by Gifu Shellac; or combinations thereof.

Additives may also be incorporated into the ink vehicle. Suitable ink additives include, for example, bactericides (e.g., PROXEL® GXL), buffers, biocides, sequestering agents, chelating agents, or the like, or combinations thereof. In some examples, the ink vehicle includes one or more additives, each of which is present in an amount ranging from about 0.1 wt % to about 0.5 wt %. In other examples, the inks contain no additives.

In an example of the ink(s) disclosed herein, the ink vehicle includes at least one solvent present in an amount ranging from about 1 wt % to about 25 wt %; at least one surfactant present in an amount ranging from about 0.1 wt % to about 8 wt %; at least one polymer present in an amount ranging from about 0 wt % to about 6 wt %; at least one additive present in an amount up to about 0.2 wt %; and water.

As mentioned above, the ink(s) also include colorants selected from pigments, dyes or combinations thereof. Some pigments include colorant particles that are substantially insoluble in the liquid vehicle. These pigments can be dispersed using a separate dispersing agent. Other pigments include colorant particles that are self-dispersing and include a dispersing agent attached to the surface of the pigment. These "self-dispersing" pigments have been functionalized with the dispersing agent, such as by chemical (e.g., covalent) attachment of the dispersing agent to the surface of the pigment. The dispersing agent, whether used as a separate agent or attached to the surface of the pigments, can be a small molecule or a polymer or oligomer.

In an example, a black ink is used. Black ink may include any commercially available black pigment that provides acceptable optical density and print characteristics. Such black pigments can be manufactured by a variety of known methods, including channel methods, contact methods, furnace methods, acetylene methods, or thermal methods, and are commercially available from such vendors as Cabot Corporation, Columbian Chemicals Company, Evonik, Mitsubishi, and E.I. DuPont de Nemours and Company. In addition to black, other pigment colorants can be used, such as cyan, magenta, yellow, blue, orange, green, pink, etc. Suitable organic colorants include, for example, azo pigments including diazo pigments and monoazo pigments, polycyclic pigments (e.g., phthalocyanine pigments such as phthalocyanine blues and phthalocyanine greens, perylene pigments, perynone pigments, anthraquinone pigments, quinacridone pigments, dioxazine pigments, thioindigo pigments, isoindolinone pigments, pyranthrone pigments, and quinophthalone pigments), insoluble dye chelates (e.g., basic dye type chelates and acidic dye type chelate), nitropigments, nitroso pigments, anthanthrone pigments such as PR168, and the like.

In some examples, the amount of colorant present in the ink compositions ranges from about 2.0 wt % to about 4.5 wt %. It is to be understood however, that the colorant loading may be more or less, as desired.

The ink contacting the previously applied treatment composition may cause the colorants present in the ink formulation to precipitate out and result in the enhancement of image quality attributes, as for example, optical density, chroma, and durability and reduced bleeding and coalescence. Indeed, without being linked by any theory, it is believed that after the treatment composition is overprinted with the ink on the medium 28 (to form the printed-on medium 28'), an effective immobilization of ink colorants is realized and nearly all of the colorants are deposited on the surface of the media 28 rather than penetrating the media 28 and existing below the surface. Concurrently, the treatment composition vehicle, upon mixing with the ink vehicle, becomes highly wetting, and the mixed vehicle quickly penetrates the media 28, leaving the colorants behind. With this printing method, the combination of treatment composition and ink provides high quality and durable image prints (i.e., printed-on media 28'). The use of the treatment composition as a pre-treatment composition results in the enhancement of image quality attributes while enabling variable and high-speed printing.

The system 10 shown in FIG. 1 includes a heating system 20. The heating system 20 is a post-print dryer that is positioned and programmed to substantially dry the printed-on medium 28' for a reduced dwell time after the treatment composition and ink have been applied thereon. By "substantially dry", it is meant that some of the moisture present in the printed-on medium 28' (i.e., after treatment composition and ink application) is driven off, volatized, or evaporated, and that some of the moisture present in the printed-on medium 28' remains in the medium 28 for a predetermined time after the reduced dwell time. The moisture i) that remains in the printed-on medium 28' after expiration of the reduced dwell time and before expiration of the predetermined time, and ii) is at a level that is higher than the initial moisture content of the medium 28 prior to treatment composition and ink application is referred to herein as residual moisture. The initial moisture content of the medium 28 is the moisture present in the medium 28 at its equilibrium at around 25% relative humidity. After expiration of the predetermined time and after the printed-on medium 28' has fully dried, the residual moisture is removed from the printed-on medium 28', and the printed-on medium 28' has a final moisture content. It is to be understood that the final moisture content is substantially the same as the initial moisture content of the medium 28 (i.e., prior to the application of treatment composition and ink). In other words, after the predetermined time and after the printed-on medium 28' has fully dried, the printed-on medium 28' returns to equilibrium. In an example, printed-on media 28' having an initial moisture content of about 5% by weight equilibrates to from about 4 wt % to about 6 wt % depending upon the relative humidity and media construction. It is to be understood that the relative humidity dependence is about +/−1% moisture change for every 10% change in relative humidity when relative humidity is between 40% and 60%. As such, it is to be understood that the residual moisture, as used herein, is the moisture differential between the initial/final moisture level of the medium 28 and printed-on medium 28' and the additional moisture amount that remains in the printed-on medium 28' after expiration of the reduced dwell time and before expiration of the predetermined time.

The residual moisture level of the printed-on medium 28' after expiration of the reduced dwell time and before expiration of the predetermined time ranges from about 3% to about 5% over the initial moisture content of the medium 28. For example, if the initial moisture content of the medium 28 is 5%, the residual moisture level may range from about 8% to about 10%. Similarly, if the initial moisture content of the medium 28 is 7%, the residual moisture level may range from about 10% to about 12%.

It has been found that the printed-on media 28' disclosed herein exhibits durability even during the time period when the printed-on media 28' contains the residual moisture. In other words, the printed-on media 28' is durable between expiration of the reduced dwell time and before expiration of the predetermined time. As used herein, durability is inferred from the optical density of the printed-on medium 28'. It is desirable that the printed-on medium 28' exhibit no loss or a minimal loss of optical density within the predetermined time, and especially after being exposed to subsequent processing, such as finishing techniques (discussed further below). No change or a minimal change in the optical density of the printed-on medium 28' is indicative of the robustness of the film (pre-treatment composition mixed with previously dispensed ink) or layer (post-treatment composition applied over ink) of the printed-on medium 28', and thus is indicative of durability. In an example, the printed-on media 28 is considered to be durable when the optical density is 1.8 immediately upon expiration (i.e., within 1 second) of the reduced dwell time, and is 1 or greater within the predetermined time period after expiration of the reduced dwell time. The immediate (i.e., within the predetermined time after the reduced dwell time) durability of the examples of the printed-on media 28' is unexpected and counter-intuitive given the level of residual moisture present in the printed-on media 28' during that time period.

The predetermined time is a time before the printed-on medium 28' is fully dry (i.e., residual moisture is removed and printed-on medium 28' reaches equilibrium). In an example, the predetermined time is less than 24 hours. In another example, the predetermined time ranges from about 2 seconds to about 60 seconds after expiration of the reduced dwell time. In this example then, the residual moisture is present in the printed-on medium 28' after expiration of the reduced dwell time and before the expiration of any of 2 seconds to 60 seconds. In another example, the predetermined time after expiration of the reduced dwell time ranges from about 1 second to about 10 seconds. In this example then, the residual moisture is present in the printed-on medium 28' after expiration of the reduced dwell time and before the expiration of any of 1 second to 10 seconds. These time frames may be particularly desirable for print applications where the printed-on media 28' is sent immediately to downstream processes, such as finishing. It is to be understood that the time to reach equilibrium depends, at least in part, on how the printed-on medium 28' is stored after exiting the heating system 20. For example, if the medium 28' is stacked or wound up in a roll, the time to reach equilibrium may be affected.

Since it has been found that the printed-on media 28' exhibits durability while containing residual moisture during the predetermined time period after the medium 28' exits the heating system 20 (i.e., after the dryer dwell time), the heating system 20 can be programmed to run at the reduced dwell time. The drying load of the system 10 disclosed herein is advantageously reduced compared to a system that does not utilize the treatment composition (either as a pre-treatment or a post-treatment) disclosed herein. The reduced dwell time for which the printed-on medium 28' is exposed to drying conditions ranges from about 1 second to about 40 seconds. The total heating system dwell time depends, at least in part, on the treatment composition and ink used, and the speed of the media transport device 16. In an example, the speed of the media transport device 16 is 60.96 mpm (i.e., 200 fpm), an air temperature of the heating system 20 is about 200° C. (i.e., about 400° F.), and drying is accomplished for 1 second. In another example, the speed of the media transport device 16 is 60.96 mpm (i.e., 200 fpm), an air temperature of the heating system 20 is about 200° C. (i.e., about 400° F.), and drying is accomplished for 2 seconds.

The heating system 20 includes any suitable dryer, such as, for example, those capable of applying heat, microwaves, convection, or other drying mechanisms. In an example, the heating system 20 includes a forced air convective dryer. In another example, the heating system 20 includes the forced air convective dryer and one or more auxiliary infrared emitters. When passed through or adjacent to the heating system 20, the printed-on media 28' may travel along a straight path (e.g., 1 pass drying or through the dryer once) or a serpentine path (e.g., 2 or more pass drying or through the dryer multiple times). When 2 pass drying is used, it is believed that the first pass adds sensible heat to the printed-on media 28' while the second pass adds latent heat and removes bulk of the moisture.

The temperature of the heating system 20 may be any suitable temperature that will not deleteriously affect the printed-on medium 28'. In an example, the component(s) of the heating system 20 is/are maintained so that the air temperature ranges from about 93° C. to about 200° C. (i.e., from about 200° F. to about 400° F.) during drying. In another example, one or more components of the heating system 20 is/are maintained at about 275° C. (see Table 4 in the Examples provided herein) so that the air temperature during drying is about 200° C. (about 400° F.).

The system 10 shown in FIG. 1 includes an in-line moisture analyzer 22. Due to the continuous nature of media 28 on a roll-to-roll press, it may be desirable to monitor moisture in the printed-on media 28' while the system 10 (or 10') is still operating, i.e., in-line or dynamic measurement. This enables a drying profile to be generated in-line. The in-line moisture analyzer 22 may be used to measure the residual moisture in the printed-on medium 28' after expiration of the reduced dryer dwell time and prior to expiration of the predetermined time. In some instances, it may be desirable to include the in-line moisture analyzer 22 prior to any finisher 24 so that if the residual moisture measurements are undesirable (e.g., too high), the finisher 24 can be turned off so that the printed-on media 28' is not prematurely exposed to finishing processes. Furthermore, if the measurements do not indicate a desirable level of residual moisture in the printed-on medium 28' within the time period, the applicators 12 or 14 and/or 18, heating system 20 and/or media transport device 16 (or 16') may be tweaked in order to optimize system performance in order to achieve prints 28' having the desirable residual moisture and durability within the time period.

Any commercially available moisture meter may be used. An example of a suitable in-line moisture analyzer 22 is a near infrared moisture analyzer (e.g., MoistTec IR3000 from MoistTec, Inc). The in-line moisture analyzer 22 may be calibrated, for example, using a solids analyzer (e.g., a microwave moisture analyzer, an example of which is available from CEM, Inc.). It is to be understood that the MoistTec analyzer may not be suitable for analyzing printed-on media 28' with black inks applied thereon, but that some other suitable moisture analyzer may be used.

The system 10 also includes a finisher 24. Since the printed-on medium 28' is durable during the time period between expiration of the reduced dwell time and prior to expiration of the predetermined time period, the printed-on medium 28' may be exposed to finishing processes within this time period. As such, finishing processes may be performed immediately after active drying (i.e., media 28' is exposed to drying conditions) takes place. Finishing processes include winding or rolling of the printed-on media 28', or cutting the printed-on media 28' and stacking the cut sheets. These in-line finishing processes may be used to rewind or package the printed-on media 28', or to generate booklets, mailings, or other desirable products within second(s) of drying without having to wait until the printed-on medium 28' reaches equilibrium and its final moisture content.

Referring now to FIG. 2, the printing system 10' includes the media transport device 16', the ink applicator 18, the post-treatment composition applicator 14, the heating system 20, and the in-line camera 26. The media transport device 16' is similar to the media transport device 16, except in this example, the media transport device 16' transports or moves the medium 28 relative to and between at least the ink applicator(s) 18, the post-treatment composition applicator(s) 14 and the heating system 20.

In the example shown in FIG. 2, the media transport device 16' is configured to transport media 28 from the ink applicator 18 to the post-treatment applicator 14 at a rate such that ink from the applicator 18 penetrates the medium 28 and one of more treatment compositions from the applicator 14 overlie the applied ink. Generally, in this example of the system 10', the media transport device 16' moves the medium 28 such that the time interval between the finishing point of the application of the ink and the starting point of the application of the treatment composition ranges from about 1 second to about 24 hours. When post-treatment composition application is in-line with ink application, the application of the treatment composition is within second(s) of the ink application. When post-treatment composition application is off-line from ink application, the application of the treatment composition may take place at any time up to 24 hours after ink application takes place. It is to be understood that the media transport device 16' may have other configurations and may operate at other speeds.

The ink applicator 18 and the ink in this example of the system 10' are the same ink applicator 18 and ink described in reference to FIG. 1, except that the ink applicator 18 is positioned within the system 10' to dispense the ink onto the medium 28 prior to application of the treatment composition.

In the example system 10' shown in FIG. 2, once the ink is applied to at least a portion of the medium 28, the media transport device 16' moves the medium 28 in proximity of the treatment applicator 14. The treatment applicator in this example of the system 10' is a post-treatment applicator 14 because it is positioned to apply the treatment composition onto the medium 28 after the ink has been applied to the medium 28. The post-treatment applicator 14 may be any of the examples set forth above for the pre-treatment applicator 12 (e.g., roller or roll coater/applicator, transfer roll coating devices, air doctor coaters, blade coaters, rod coaters, knife coaters, squeeze coaters, impregnation coaters, reverse roll coaters, transfer roll coaters, gravure coaters, kiss-roll coaters, cast coaters, spray coaters, curtain coaters, inkjet devices, and extrusion coaters).

The treatment composition contained in the post-treatment applicator 14 is the same as the treatment composition previously described in reference to FIG. 1, and includes the liquid vehicle, the polyvalent metal salt as fixing agent, the latex resin, and in some instances, the thickener.

Without being linked by any theory, it is believed that within the viscosity and surface tension ranges set forth above for the treatment composition liquid vehicle, the treatment composition does not penetrate the media 28 too fast and allows the fluid to remain near the media surface. When ink(s) is applied on the medium 28 first, it penetrates the media 28 and exists below the surface. The post-treatment composition then forms a layer over the previously printed ink. This layer is believed to enhance at least the durability and gloss of the printed-on media 28' that is formed.

The system 10' shown in FIG. 2 also includes the heating system 20. The heating system 20 is the same post-print dryer previously described in reference to FIG. 1 that is positioned and programmed to substantially dry the printed-on medium 28' for a reduced dwell time after the ink and treatment composition have been applied thereon. The heating system 20 in FIG. 2 is programmed to result in the formation of printed-on media 28' that contains residual moisture and exhibits durability after expiration of the reduced dwell time and before expiration of the predetermined time.

The system 10' shown in FIG. 2 also includes the in-line camera 26. The in-line camera 26 is positioned to measure the exit temperature of the printed-on media 28' as it exits the heating system 20. The in-line camera 26 may be positioned, for example, from about 10 inches to about 20 inches from the exit of the heating system 20 (e.g., from the exit of the dryer used). In an example, the in-line camera 26 is positioned about 16 inches from the dryer exit. One example of the in-line camera is a thermal imaging camera, which may have software packaged with the camera. This type of camera is commercially available as Testo 875, from Testo, USA.

The following Examples are provided to illustrate the printing systems and resulting printed-on media of the present disclosure. It is to be understood that these examples are provided for illustrative purposes and are not to be construed as limiting the scope of the disclosure.

EXAMPLE 1

A series of experiments was carried out to quantify moisture removal and print exit temperature as a function of drying parameters for a forced air convective dryer. The system included a pre-treatment applicator, an ink applicator, a forced air convective dryer (with or without Heraeus medium and short-wave IR emitters), a Testo 875 thermal imaging camera to monitor media exit temperatures, and a MoistTec IR3000 moisture analyzer to measure the residual moisture in-line (set to log data at 250 millisecond intervals).

A clear inkjet ink and the treatment composition disclosed herein were used. Tables 1 and 2 illustrate the clear ink and pre-treatment compositions, respectively. Sterling Ultra Gloss (SUG) coated offset media was used.

TABLE 1

| Clear Ink Components | Amount (wt %) |
|---|---|
| Alkali-soluable, lower acid resin | 1.0 |
| 2-Pyrrolidone | 10.0 |
| LEG-1 | 1.0 |
| Non-ionic fluorosurfactant | 0.1 |
| Aqueous Solution of 1,2-benzisothiazolin-3-one | 0.1 |
| Water | Balance (up to 100) |

TABLE 2

| Pre-Treatment Components | Amount (wt %) |
|---|---|
| Resin | 33.0 |
| 2-Pyrrolidone | 3.0 |
| Calcium Chloride | 7.0 |
| Non-ionic fluorosurfactant | 0.1 |
| Organic silicone-free self-emulsifiable defoamer | 0.5 |

TABLE 2-continued

| Pre-Treatment Components | Amount (wt %) |
|---|---|
| Biocide | 0.1 |
| Water | Balance (up to 100) |

Three system configurations were used in this Example. In the first system configuration (#1), the media was not passed through the dryer. This allowed wet prints to be sampled quickly after printing. The other systems had different dryer configurations. The second system configuration (#2) involved a 2 second dryer dwell time in which the printed-on media was passed through the forced air convective dryer for 2 seconds. The third system configuration (#3) involved a 1 second dryer dwell time in which the printed-on media was passed through the forced air convective dryer for 1 second. The third system configuration also included two auxiliary IR dryers to be independently utilized along with the forced air drying.

The images printed were of a known print density and print area (4.25"×8"). The print density was calculated based upon the drop weight and the number of drops per DPI area.

The media alone (without any treatment composition or ink application) was run through the system without drying to obtain a baseline of how much moisture was in the media prior to printing. A sample was collected and placed into an offline microwave moisture analyzer (CEM, Inc., i.e., the offline CEM analyzer) to determine the moisture content. The moisture content (%) for the media plus pre-treatment composition, the media plus ink, and the media plus pre-treatment composition and ink was then calculated based upon the baseline. These values are shown in Table 3.

TABLE 3

| Source | Print Density (%) |
|---|---|
| Media alone | 6 |
| Media plus pre-treatment composition | 6.9 |
| Media plus ink | 10.2 |
| Media plus pre-treatment composition and ink | 11 |

The calculated values in Table 3 were based upon runs where pre-treatment alone was printed, where ink alone was printed, and where both the pre-treatment composition and the ink were printed. These runs did not involve drying. Samples were taken from each of these runs and the microwave moisture analyzer was used to determine the moisture content.

Runs were then performed using each system configuration (1, 2, 3) so that the different drying configurations were tested. All thermal readings were taken from a distance of 16 inches from the exit of the forced air convective dryer. The heating element was set at 275° C. (as shown in Table 4) so that the air temperature of the forced air convective dryer was about 200° C. and the web speed was 30.48 mpm (i.e., 100 fpm). When the IR emitters were used, only one was used at a time.

The first four runs (i.e., runs 1-4) were the no drying configuration (#1), and the media path for these runs bypassed the dryer. The next four runs (i.e., runs 5-8) were the 2 second drying configuration (#2), and the media path for these runs passed through the forced air convective dryer for 2 seconds. The next four runs (i.e., runs 9-12) were the 1 second drying configuration (#3), and the media path for these runs passed through the forced air convective dryer for 1 second. The last two runs (i.e., runs 13 and 14) were the 1 second drying plus IR emitter configuration (IR modified #3), and the media path for these runs passed by one of the IR emitters (the short wave or the medium wave IR emitter) and then through the forced air convective dryer for 1 second.

It is to be understood that each of the runs was performed multiple times on two different dates, and the average results for the respective runs on the respective dates were calculated. Table 4 illustrates the parameters and results for the average of each of the runs performed on the respective dates.

Figure 3:
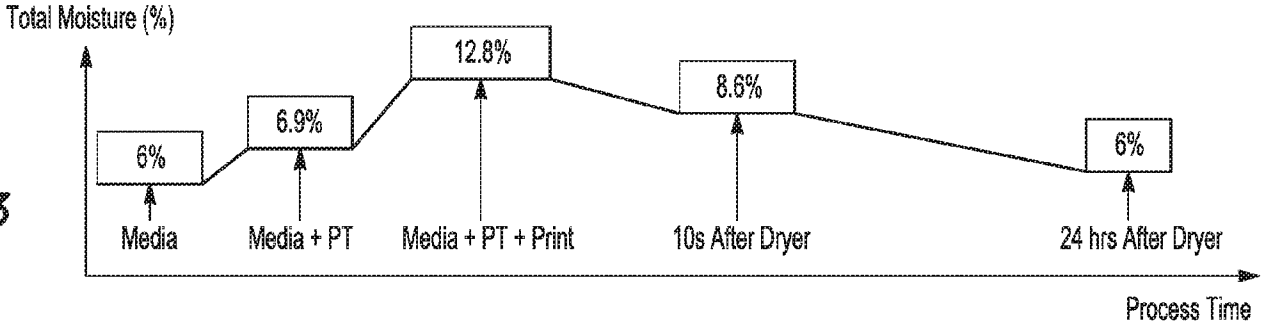
FIG. 3 is a graph illustrating the moisture profile of a print (including treatment composition and ink) subjected to a 2 second dryer dwell time (i.e., the second print system configuration (#2) outlined in Example 1 below), the moisture profile being shown during printing, during drying, immediately after drying, and 24 hours after drying.

During the experiments, the performance of the in-line moisture analyzer (moisture meter, MoistTec, Inc.) was validated using the offline solids analyzer (CEM analyzer, CEM, Inc.). The offline solids analyzer was used to test the residual moisture of the samples, and this data was compared with the in-line moisture data. Data collected from the offline solids analyzer moisture measurements was also used to calibrate the in-line moisture analyzer. As shown in Table 4, the measurements from the offline solids analyzer agreed with the measurements taken with the in-line moisture analyzer.

seconds after drying, and 24 hours after drying. The average of the different moisture levels taken at the different points in system #2 are shown in FIG. 3. FIG. 3 is meant to be a visual representation of how much moisture is being put onto the media during the printing process, how much moisture is removed when passing through the dryer, and how much residual moisture remains in the printed-on medium within the predetermined time frame after exiting the dryer.

According to the results shown in FIG. 3, the media itself started with 6% moisture at its equilibrium at around 25% relative humidity. Note that 12.8% of moisture was measured on the media when a full density print was used. A moisture measurement of 8.6% was made for the media leaving the dryer (~10 seconds after dryer exit) indicating that not all of the deposited moisture was removed (i.e., residual moisture was present). Excellent ink durability was witnessed for the samples leaving the dryer. The residual moisture left in the printed-on media after drying and within the predetermined time period eventually leaves the media, bringing the media back to its equilibrium of 6% moisture.

TABLE 4

| | | | | | | | | Volatile Content of Media (%) | | | |
|---|---|---|---|---|---|---|---|---|---|---|---|
| Run # | System Config. | Web Speed (mpm) | IR | Air Temp | Image (PA = print area) | M, PT, &/or I* | Drying Paper Path | Moisture Meter Date 1 | Moisture Meter Date 2 | CEM Analyzer Date 1 | CEM Analyzer Date 2 |
| 1 | 1 | 30.48 | None | None | None | M | ND** | — | 5.69 | — | 6.05 |
| 2 | 1 | 30.48 | None | None | None | PT | ND | — | 6.48 | — | 7.08 |
| 3 | 1 | 30.48 | None | None | 4" × 20" PA | I | ND | — | 10.38 | — | 10.57 |
| 4 | 1 | 30.48 | None | None | 4" × 20" PA | PT + I | ND | — | 11.74 | — | 11.19 |
| 5 | 2 | 30.48 | None | 200° C. | None | M | 2 sec. | 4.39 | 4.94 | 4.24 | 4.95 |
| 6 | 2 | 30.48 | None | 200° C. | None | PT | 2 sec. | 4.53 | 5.26 | 4.73 | 5.27 |
| 7 | 2 | 30.48 | None | 200° C. | 4" × 20" PA | I | 2 sec. | 6.53 | 6.66 | 4.52 | 5.88 |
| 8 | 2 | 30.48 | None | 200° C. | 4" × 20" PA | PT + I | 2 sec. | 6.70 | 7.51 | 7.09 | 7.09 |
| 9 | 3 | 30.48 | None | 200° C. | None | M | 1 sec. | 4.39 | 4.98 | 4.61 | 5.27 |
| 10 | 3 | 30.48 | None | 200° C. | None | PT | 1 sec. | 4.46 | 5.75 | 4.71 | 5.54 |
| 11 | 3 | 30.48 | None | 200° C. | 4" × 20" PA | I | 1 sec. | 5.43 | 6.90 | 5.87 | 6.90 |
| 12 | 3 | 30.48 | None | 200° C. | 4" × 20" PA | PT + I | 1 sec. | 6.44 | 7.65 | 6.74 | 7.76 |
| 13 | IR modified 3 | 30.48 | Short IR emitteron | 200° C. | 4" × 20" PA | PT + I | 1 sec. w/ Short IR | 5.66 | 6.90 | 6.70 | 7.16 |
| 14 | IR modified 3 | 30.48 | Med. IR emitteron | 200° C. | 4" × 20" PA | PT + I | 1 sec. w/ Med. IR | 6.07 | 6.90 | 6.29 | 6.96 |

*M = media, PT = pre-treatment composition, I = ink
**ND = no drying

Runs similar to Run 8 in Table 4 were performed using a print speed of 60.96 mpm (200 fpm) and using black ink instead of clear ink. The composition for the black ink is shown in Table 5.

TABLE 5

| Black Ink Components | Amount (wt %) |
|---|---|
| Black Pigment | 3.0 |
| Black pigment dispersion | 1.0 |
| Alkali-soluable, lower acid resin | 1.0 |
| 2-Pyrrolidone | 10.0 |
| LEG-1 | 1.0 |
| Non-ionic fluorosurfactant | 0.1 |
| Aqueous Solution of 1,2-benzisothiazolin-3-one | 0.1 |
| Water | Balance (up to 100) |

For these runs, the moisture content was measured for the media alone, media plus pre-treatment composition, media plus pre-treatment composition and ink during printing, 10

The moisture profile results shown in FIG. 3 differ from those shown in Table 4 at least in part because black ink was used instead of clear ink. Drop weight variations between the clear ink and the black ink are believed to account for the moisture differences reported. The difference in moisture content was estimated to be about 1.8%.

EXAMPLE 2

A separate set of experiments were performed to correlate moisture removal and media exit temperature to durability.

SUG coated offset media used in this example, except the initial moisture content was 5%. The same type and amount of pre-treatment composition and clear ink were printed as discussed in Example 1 using the second printing system configuration (i.e., 2 second drying/dwell time) and conditions (i.e., speed of 30.48 mpm (i.e., 100 fpm), air temp about 200° C.). Also in this example, a comparative print was generated where ink was printed with no pre-treatment composition.

Figure 4:
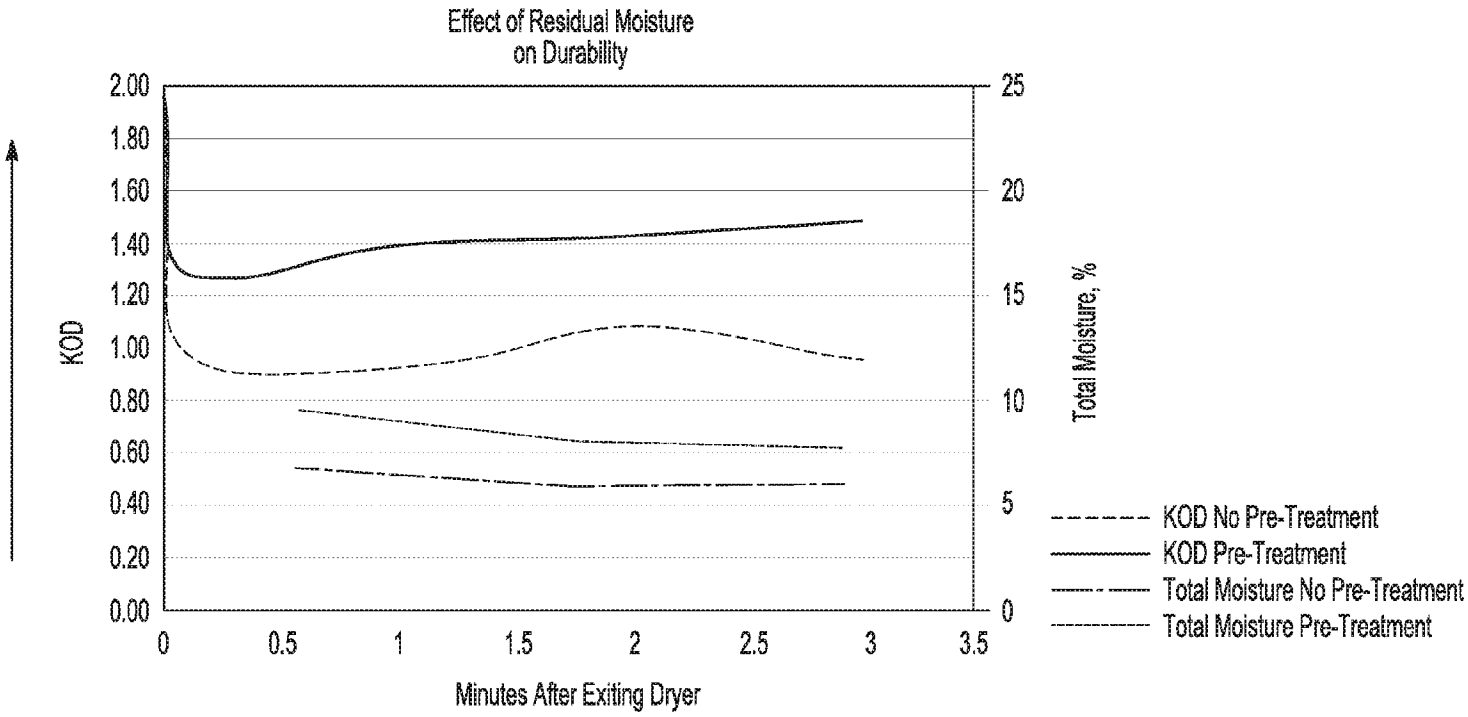
FIG. 4 is a graph illustrating the durability and residual moisture of an example of a sample print with treatment composition and a comparative print without treatment composition.

The durability (inferred from optical density KOD) and total moisture for the printed-on medium and the comparative print were determined. Optical density was measured with a densitometer, both before and after a rub test. The rub was performed with an eraser under a 26.69 Newton (i.e., about a 6 pound) force. The optical density of the rubbed areas was compared with the optical density of the unrubbed areas. Disruption to the ink film layer under load is an indication of the film layer's durability. A change in optical density after rub is an indication of durability (as described above in the detailed description), and thus durability can be inferred from these results. Total moisture was determined as described for the samples in Example 1. These results are shown in FIG. 4. As illustrated, the sample including the pre-treatment composition had higher total moisture (and thus higher residual moisture as the term is defined herein) and better optical density (higher number=better KOD) and thus durability than the comparative sample without the pre-treatment composition.

The results of Examples 1 and 2 demonstrate that the printed-on media disclosed herein having the treatment composition applied thereon tends to trap moisture at a certain level immediately after printing and prior to full drying. The results also demonstrate that the printed-on media is durable during this time period. As a result, the drying load may be significantly reduced (when compared to systems not using the treatment composition disclosed herein), and in-line finishing processes may be performed while the printed-on media contains residual moisture.

It is to be understood that the ranges provided herein include the stated range and any value or sub-range within the stated range. For example, a size ranging from about 3% to about 5% should be interpreted to include not only the explicitly recited amount limits of about 3% to 5%, but also to include individual amounts, such as 2%, 2.5%, 4%, etc., and sub-ranges, such as 2% to 4%, etc. Furthermore, when "about" is utilized to describe a value, this is meant to encompass minor variations (up to +1-5%) from the stated value.

Still further, it is to be understood use of the words "a" and "an" and other singular referents include plural as well, both in the specification and claims.

While several examples have been described in detail, it will be apparent to those skilled in the art that the disclosed examples may be modified. Therefore, the foregoing description is to be considered non-limiting.

What is claimed is:

1. A printing system, comprising:

a media transport device to move a medium at a speed ranging from about 15.24 mpm to about 609.6 mpm;

an ink applicator to apply ink on the medium;

a treatment applicator to apply a treatment composition on the medium before or after the ink is applied on the medium to form a printed-on medium, the treatment composition including a liquid vehicle, a polyvalent metal salt fixing agent, and a latex resin having an acid number less than 20:

a heating system having an infrared (IR) emitter, said heating system being programmed to: i) dry the printed-on medium at a predetermined temperature for a reduced dwell time ranging from about 1 second to about 40 seconds; and ii) leave residual moisture in the printed-on medium for a predetermined time after the reduced dwell time, the residual moisture being at a level that is higher than an initial moisture content of the medium prior to treatment composition and ink application; and an in-line thermal imaging camera to monitor an exit temperature of the printed-on medium from the heating system.

2. The printing system as defined in claim 1 wherein the heating system is further programmed to dry the medium such that the residual moisture level within 10 seconds of the reduced dwell time ranges from about 3% to about 5% over the initial moisture content of the medium.

3. The printing system as defined in claim 1 wherein the heating system includes a forced air convective dryer.

4. The printing system as defined in claim 1, further comprising an in-line moisture analyzer to measure the residual level of the printed-on medium.

5. The printing system as defined in claim 1 wherein:

the treatment applicator is positioned and programmed to apply the treatment composition on the medium; and the ink applicator is positioned and programmed to apply the ink to the treatment composition on the medium within a predetermined time of the treatment composition being applied.

6. A printing method, comprising:

transporting a medium through a printer at a speed ranging from about 15.24 mpm to about 609.6 mpm;

applying ink on the medium;

applying a treatment composition on at least a portion of the medium before or after the ink is applied thereon, thereby forming a printed-on medium, the treatment composition including a liquid vehicle, a polyvalent metal salt fixing agent, and a latex resin having an acid number less than 20;

drying the printed-on medium at a predetermined temperature using as heating system having an infrared (IR) emitter for a reduced dwell time ranging from about 1 second to about 40 seconds, thereby leaving residual moisture in the printed-on medium for a predetermined time after the reduced dwell time, the residual moisture being at a level that is higher than an initial moisture content of the medium prior to treatment composition and ink application; and monitoring an exit temperature of the printed-on medium using an in-line thermal imaging camera.

7. The printing method as defined in claim 6 wherein:

the treatment composition is applied to at least a portion of the medium; and the ink is applied to the treatment composition within a predetermined time of the treatment composition being applied.

8. The printing method as defined in claim 6 wherein:

the ink is applied to at least a portion of the medium; and the treatment composition is applied to the ink on the medium.

9. The printing method as defined in claim 6, further comprising performing a finishing process within 10 seconds of the printed-on medium exiting a dryer used in the drying step.

10. A printing method, comprising:

transporting a medium through a printer at a speed ranging from about 15.24 mpm to about 609.6 mpm;

applying ink on the medium;

applying a treatment composition on at least a portion of the medium before or after the ink is applied thereon, thereby forming a printed-on medium, the treatment composition including a liquid vehicle, a polyvalent metal salt fixing agent, and a latex resin having an acid number less than 20;

drying the printed-on medium at a predetermined temperature for a reduced dwell time ranging from about 1 second to about 40 seconds, thereby leaving residual moisture in the printed-on medium for a predetermined time after the reduced dwell time, the residual moisture being at a level that is higher than an initial moisture content of the medium prior to treatment composition and ink application;

performing a finishing process within 10 seconds of the printed-on medium exiting a dryer used in the drying step, wherein the finishing process is selected from rolling the printed-on medium, or cutting the printed-on medium into sheets and stacking the sheets; and measuring the residual moisture level within 10 seconds of the printed-on medium exiting the dryer.

11. The printing method as defined in claim 10 wherein the residual moisture level ranges from about 3% to about 5% over the initial moisture content of the medium, and wherein the printed-on medium exhibits a minimal optical density loss or no optical density loss within the predetermined time after the printed-on medium is exposed to the reduced dwell time.

* * * * *